US006089355A

United States Patent [19]

Seki et al.

[11] Patent Number: 6,089,355

[45] Date of Patent: Jul. 18, 2000

[54] ELEVATOR SPEED CONTROLLER

[75] Inventors: Yoshiro Seki; Hiroyuki Ohashi, both of Tokyo, Japan

[73] Assignee: Kabushiki Kaisha Toshiba, Kawasaki, Japan

[21] Appl. No.: 09/141,019

[22] Filed: Aug. 27, 1998

[30] Foreign Application Priority Data

Sep. 9, 1997 [JP] Japan ..... 9-244330

[51] Int. Cl.[7] ..... B66B 1/34

[52] U.S. Cl. ..... 187/292; 187/393

[58] Field of Search ..... 187/393, 391, 187/292, 293

[56] References Cited

U.S. PATENT DOCUMENTS 5,120,023 6/1992 Kawabata ..... 254/275
5,542,501 8/1996 Ikejima et al. ..... 187/292
5,747,755 5/1998 Coste et al. ..... 187/394
5,824,975 10/1998 Hong ..... 187/292
5,828,014 10/1998 Goto et al. ..... 187/292

*Primary Examiner*—Jonathan Salata
*Attorney, Agent, or Firm*—Oblon, Spivak, McClelland, Maier & Neustadt, P.C.

[57] ABSTRACT

To provide an elevator speed controller capable of suppressing vibration of an elevator of which natural frequency is largely variable and enabling a highly accurate speed control irrespective of change in elevator characteristic and easy adjustment. An elevator speed controller, comprising a car speed command value setting means to set a car speed command value upon receipt of an elevator starting command to move a car up/down via a rope wound around a sheave by driving the sheave by a motor and a car speed command value correcting means to correct a car speed command value set by the car speed command value setting means by a vibration detected value detected by a car vibration detecting means so as to suppress the car vibration, in structure to control a motor speed according to a corrected car speed command value.

4 Claims, 8 Drawing Sheets

ELEVATOR SPEED CONTROLLER

BACKGROUND OF THE INVENTION

1. Field of the Invention

The present invention relates to an elevator speed controller which moves up and down a car via a rope wound around a sheave by driving this sheave by a motor.

2. Description of the Related Art

FIG. 7 is a schematic block diagram of an elevator which is called a well bucket type out of rope type elevators. In FIG. 7, a motor 4 is installed on the roof of a building and rotates a sheave 11 which is part of an elevator mechanical system 10. A rope 12 is wound around the sheave 11. A car 13 is connected to one end of the rope 12 and a counter weight 14 is connected to the other end of the rope 12. This counter weight is set at the mass almost equal to the car 13 to balance with it. So, when the car 13 is moved up or down by driving the motor 4, the counter weight 14 serves to reduce load of the motor 4, save energy and downsize the motor.

FIG. 8 is a block diagram showing the structure of the speed control system of the elevator mechanical system shown in FIG. 7. In FIG. 8, 1 is a car speed command value setting means to set a car speed command value upon receipt of an elevator starting command and a known car speed command value that is set is added to a speed conversion means 2. The speed conversion means 2 converts a car speed command value into a speed command value of the motor 4 and adds a converted speed command value to a motor controller 3. The motor controller 3 controls the current of the motor so that a speed detected value by a motor speed detecting means 5 follows a speed command value converted by the speed converting means 2. So, a car speed is controlled so as to become equal to a car speed command value.

The conventional elevator speed controller described above controls the speed of the car 13 by driving the motor 4 according to a desired car speed command value regarding the elevator mechanical system 10 to be a rigid body. At the time, vibrations of a car caused by jumping of passengers, distortion of rails, resonance of the mechanical system, etc. were suppressed mechanically by installing dampers, vibration isolating rubbers and the like.

However, since an elevator is a system of which natural frequency changes largely due to load and the position of a car, it couldn't suppress oscillation to substantially zero by such a mechanical vibration isolating means as dampers, vibration isolating rubbers, etc. and vibrations generated at some specific floor or specific load became a problem. This tendency was remarkable in case of a long distance and super high-speed elevator of which a change of natural frequency was specifically large.

Further, in order to realize the high accurate speed control it is desirable to always update a control gain according to these detected values irrespective of change in load and a car position; however, as there is no guide line and an enormous adjusting time is required in the trial and error, a control gain was so far set at a constant level. However, it became necessary to readjust the control gain some time according to specifications and demanded performance of an elevator and as the adjustment was made in the trial and error, its efficiency was also low.

SUMMARY OF THE INVENTION

The present invention has been made in view of the above and it is a first object of the present invention to provide an elevator speed controller capable of suppressing vibrations of an elevator having a large change in natural frequency.

A second object of the present invention is to provide an elevator speed controller which enables a high accurate speed control and is easy to adjust a control gain irrespective of characteristic change of an elevator.

In an elevator speed controller for moving a car up/down via a rope wound around a sheave comprising a mechanical system of a rope type elevator by driving a motor; which is equipped with a car speed command value setting means to set a car speed command value in compliance with a given starting command; and a motor controller to control the motor speed following a car speed command value that was set by the car speed command value setting means, an elevator speed controller of the present invention is characterized in that it is composed of a car vibration detecting means to detect the car vibration and a car speed command value correcting means provided between the car speed command value setting means and the motor controller, correct the car speed command value set by the car speed command value setting means according to a vibration detected value detected by the car vibration detecting means so as to suppress a car vibration and supplies a corrected car speed command value to the motor controller.

Further, in an elevator speed controller for moving a car up/down via a rope wound around a sheave comprising a mechanical system of a rope type elevator by driving a motor; which is equipped with a car speed command value setting means to set a car speed command value in compliance with a given starting command; and a motor controller to control the motor speed following a car speed command value that was set by the car speed command value setting means, an elevator speed controller of the present invention is characterized in that it is composed of a motor speed detecting means to detect a motor speed; a car vibration detecting means to detect a car vibration; and a car speed command value correcting means provided between the car speed command value setting means and the motor controller to correct a car speed command value set by the car speed command value setting means according to a motor speed detected value detected by the motor speed detecting means and a vibration detected value detected by the car vibration detecting means so as to suppress a car vibration and supplies a corrected car speed command value to the motor controller.

In an elevator speed controller for moving a car up/down via a rope wound around a sheave comprising a mechanical system of a rope type elevator by driving a motor; which is equipped with a car speed command value setting means to set a car speed command value for every sampling period in compliance with a given starting command ;and a motor controller to control the motor speed following the car speed command value that was set by the car speed command value setting means, an elevator speed controller for achieving the present invention using a digital controller is characterized in that it is composed of a car vibration detecting means to detect a car vibration; and a car speed command value correcting means provided between the car speed command value setting means and the motor controller to correct the car speed command value set for every sampling period by the car speed command value setting means according to a vibration detected value detected by the car vibration detecting means so as to suppress a car vibration and supplies a corrected car speed command value to the motor controller.

In an elevator speed controller for moving a car up/down via a rope wound around a sheave comprising a mechanical system of a rope type elevator by driving a motor; which is equipped with a car speed command value setting means to set a car speed command value for every sampling period in compliance with a given starting command; and a motor controller to control the motor speed following the car speed command value that was set by the car speed command value setting means, an elevator speed controller for achieving the present invention using a digital controller is characterized in that it is composed of a motor speed detecting means to detect a motor speed; a car vibration detecting means to detect a car vibration; and a car speed command value correcting means provided between the car speed command value setting means and the motor controller to correct the car speed command value set for every sampling period by the car speed command value setting means according to a motor speed detected value detected by the motor speed detecting means and a vibration detected value detected by the car vibration detecting means so as to suppress a car vibration and supplies a corrected car speed command value to the motor controller.

DETAILED DESCRIPTION OF THE PREFERRED EMBODIMENTS

Hereinafter, the present invention will be described in detail based on suitable embodiments.

Figure 1:
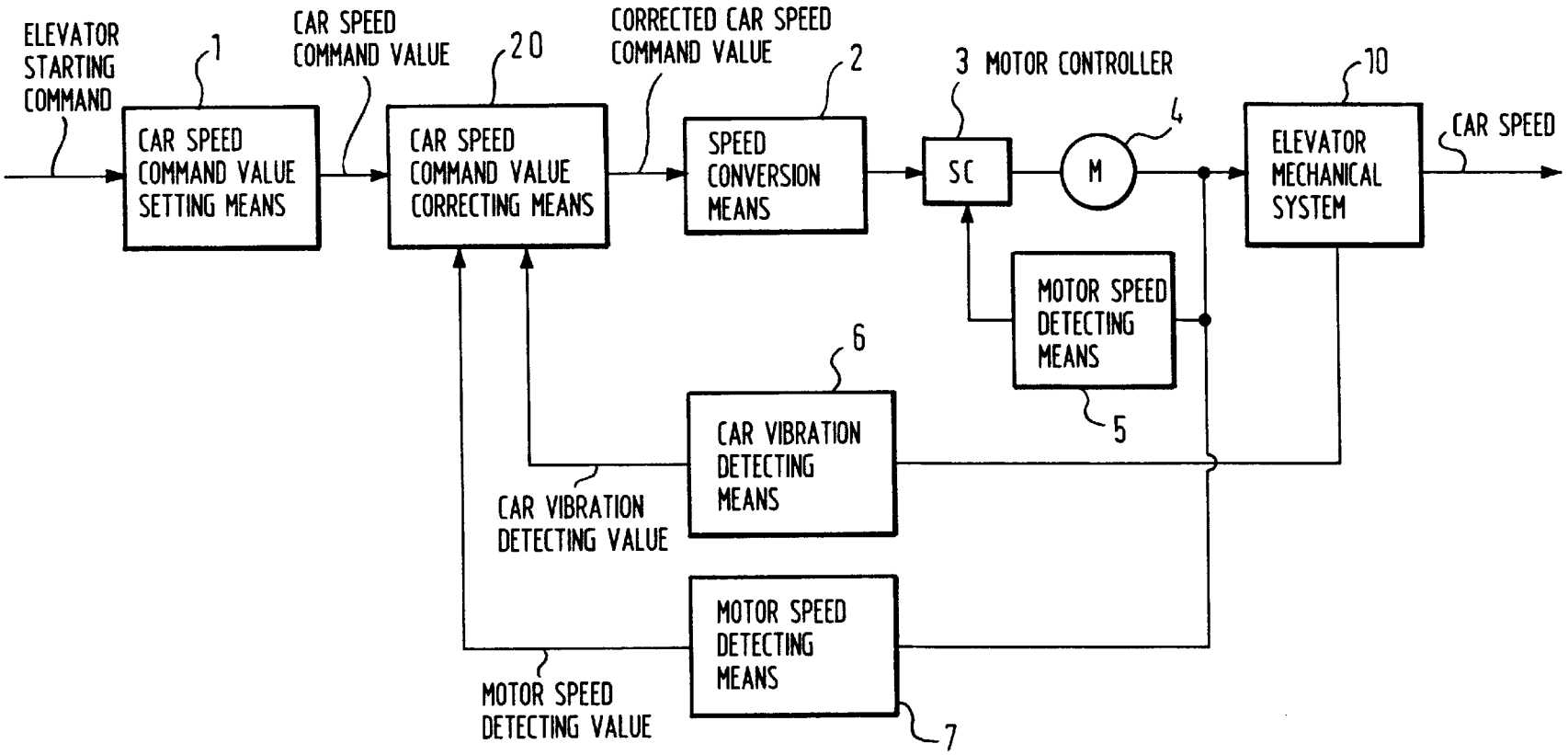
FIG. 1 is a block diagram showing the entire structure of a first embodiment of the present invention.
Figure 8:
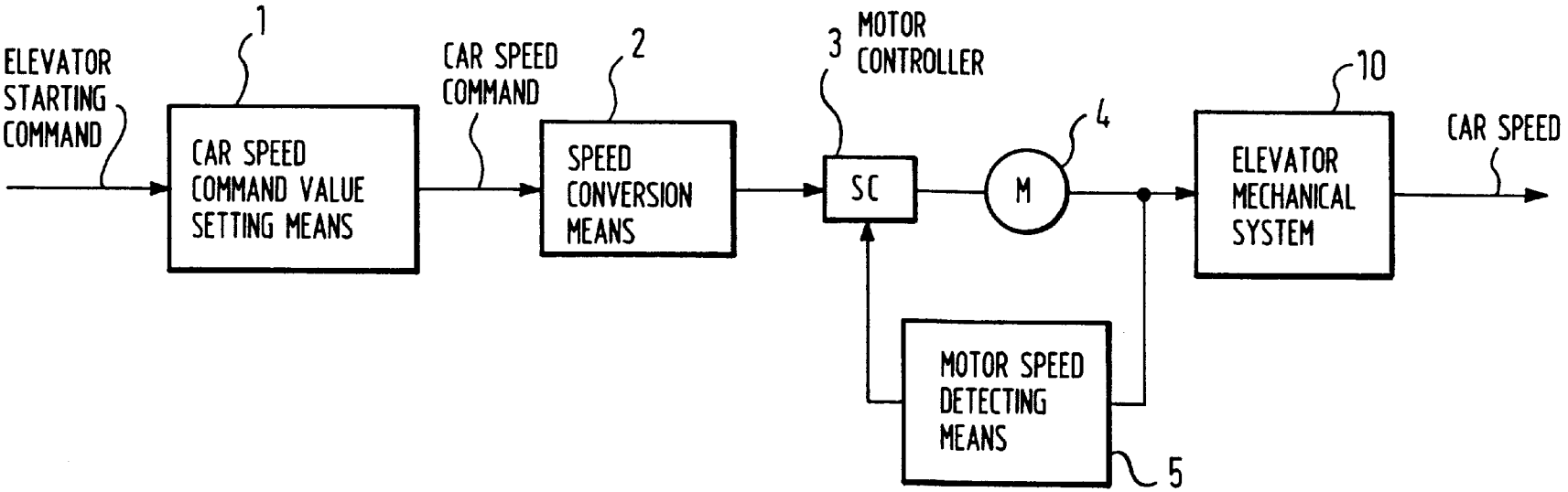
FIG. 8 is a block diagram showing the entire structure of the speed controller of a conventional elevator.

FIG. 1 is a block diagram showing the structure of a first embodiment of the present invention and in FIG. 1, the same component elements as those in FIG. 8 showing a conventional elevator speed controller are assigned with the same numerals. Here, a car vibration detecting means 6 to detect the vibration of the car 13 comprising the elevator mechanical system 10, a motor speed detecting means 7 to detect a speed of the motor 4 and converting it into a car speed and output the converted car speed and a car speed command value correcting means 20 to correct a car speed command value that is output from the car speed command value setting means 1 according to the car vibration detected value and the motor speed detected value which are detected by these detecting means, respectively and add the corrected car speed command value to the speed conversion means 2 are added to the conventional elevator speed controller shown in FIG. 8.

Here, for the car vibration detecting means 6, an accelerometer or a load detector is usable. For the motor speed detecting means 7, a tachometer is usable when an elevator speed controller is of analog type and a pulse generator, etc. are usable when a controller is of digital type.

Figure 2:
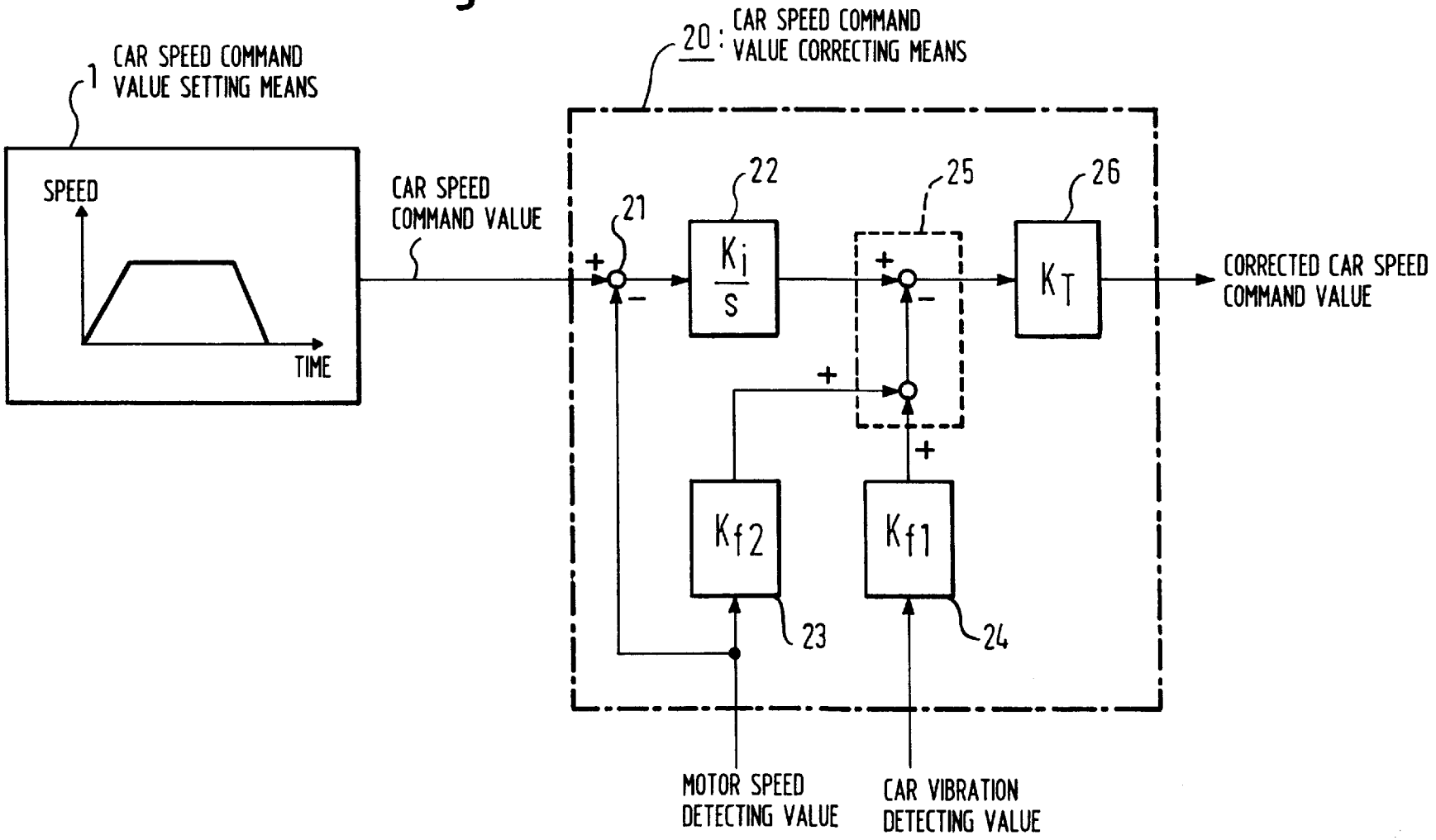
FIG. 2 is a block circuit diagram showing the detailed structure of principal parts of the embodiment shown in FIG. 1.

FIG. 2 is a block circuit diagram showing the detailed structure of the car speed command value correcting means 20. In this figure, a subtracting means 21 as a speed deviation computing means subtracts a motor speed detected value by the motor speed detecting means 7 from the car speed command value that is output from the car speed command value setting means 1 and outputs it to an integrating means 22. The integrating means 22 multiplies the output of the subtracting means 21 by a constant $K_i$, integrates an obtained value and outputs to an adding/subtracting means 25. A coefficient multiplying means 23 multiplies a motor speed detected value by the motor speed detecting means 7 by a constant $K_{f2}$ and a coefficient multiplying means 24 multiplies a car vibration detected value by the car vibration detecting means 6 by a coefficient $K_{f1}$ and output the values thus obtained to the adding/subtracting means 25, respectively.

The adding/subtracting means 25 comprises an adding means which adds the output of the coefficient multiplying means 23 and the output of the coefficient multiplying means 24 and a subtracting means which subtracts the output of this adding means from the output of the integrating means 22 and outputs its output to a coefficient multiplying means 26. The coefficient multiplying means 26 multiplies the output of the adding/subtracting means 25 by a coefficient $K_T$ and outputs a corrected car speed command value.

The operation of the car speed controller of the present invention in the first embodiment in such structure as shown above will be described hereunder especially centering around the portions in differing structure from a conventional car speed controller.

This embodiment is in such structure that when a car speed command value is converted into a motor speed command value, a car speed command value is corrected according to the vibration information of a car so as to suppress the vibration and at the same time, to move a car according to the speed command value, and control gains as coefficients are predetermined. That is, an integrating gain $K_i$, feedback gains $K_{f1}$, $K_{f2}$ and a total gain $K_T$ are determined in advance.

Then, the subtracting means 21 subtracts a motor speed detected value detected by the motor speed detecting means 7 from a car speed command value that is set by the car speed command value setting means 1 and computes a speed deviation. The integrating means 22 multiplies this speed deviation by the integrating gain $K_i$, integrates the thus obtained value and outputs the integrated value. The coefficient multiplying means 23 multiplies a motor speed detected value detected by the motor speed detecting means 7 by the feedback gain $K_{f2}$ and outputs a multiplied value and the coefficient multiplying means 24 multiplies a car vibration detected value detected by the car vibration detecting means 6 by the feedback gain $K_{f1}$ and outputs the multiplied value.

The adding/subtracting means 25 adds up the output of the coefficient multiplying means 23 with the output of the coefficient multiplying means 24, and subtracts this added value from the output of the integrating means 22 and outputs the obtained value. The coefficient multiplying means 26 multiplies the output of the adding/subtracting means 25 by the total gain $K_T$ and outputs the obtained value as a corrected car speed command value. Thus, the car speed command value correcting means 20 corrects a car speed command value set by the car speed command value setting means 1 and outputs it to the speed conversion means 2.

Here, the integrating gain $K_i$, feedback gains $K_{f1}$, $K_{f2}$ and total gain $K_T$ are decided to values shown by the following expressions.

$$K_i=\omega_c \quad (1)$$

$$K_{f1}=M_T/K_c \quad (2)$$

(when a car vibration detected value is an acceleration signal)

$$K_{f1}=1/K_c \quad (3)$$

(When a car vibration detected value is a load signal)

$$K_{f2}=1 \quad (4)$$

$$K_T=\sigma\cdot\omega_c \quad (5)$$

$$K_c=K_0/L \quad (6)$$

where, $\omega_c$: Coefficient for adjustment $M_T$: A car total mass that is the sum total of a car weight with no load and movable load $K_c$: Spring constant of rope $K_0$: Spring constant per unit length of rope $\sigma$: Coefficient for adjustment L: Rope length Further, the rope length L is a length of rope from the sheave 11 to the car 13 and can be easily obtained from the position of the car. Coefficients for adjustment $\omega_c$, $\sigma$ are for minimizing the car vibration.

The car speed command values corrected by the car speed command correcting means 20 are as follows: When the car vibration detected value is an acceleration signal:

$$V_{sref}=K_T\cdot\{K_i\int(V_{ref}-V_{sfbk})\,dt-K_{f2}\cdot V_{sfbk}-M_T/K_c\cdot\alpha_c\} \quad (7)$$

When the car vibration detected value is a load signal:

$$V_{sref}=K_T\cdot\{K_i\int(V_{ref}-V_{sfbk})\,dt-K_{f2}\cdot V_{sfbk}-1/K_c\cdot f_c\} \quad (8)$$

where, $V_{sref}$: A corrected car speed command value (sheave speed reference)

$V_{ref}$: A car speed command value (car speed reference)

$V_{sfbk}$: Motor speed detected value (actual sheave speed value)

$\alpha_c$: Car acceleration $f_c$: Change in car load

In the expressions shown above, most effective car speed command values for suppressing car vibration are $M_T/K_c\cdot\alpha_c$ and $1/K_c\cdot f_c$ and when driving a motor according to corrected car speed command values (7), (8), the motor itself acts as a suppressing device to the vibration and operates stably as a car driving device.

The effects of said first embodiment will be described using Bode diagrams obtained by the simulation.

Figure 3:
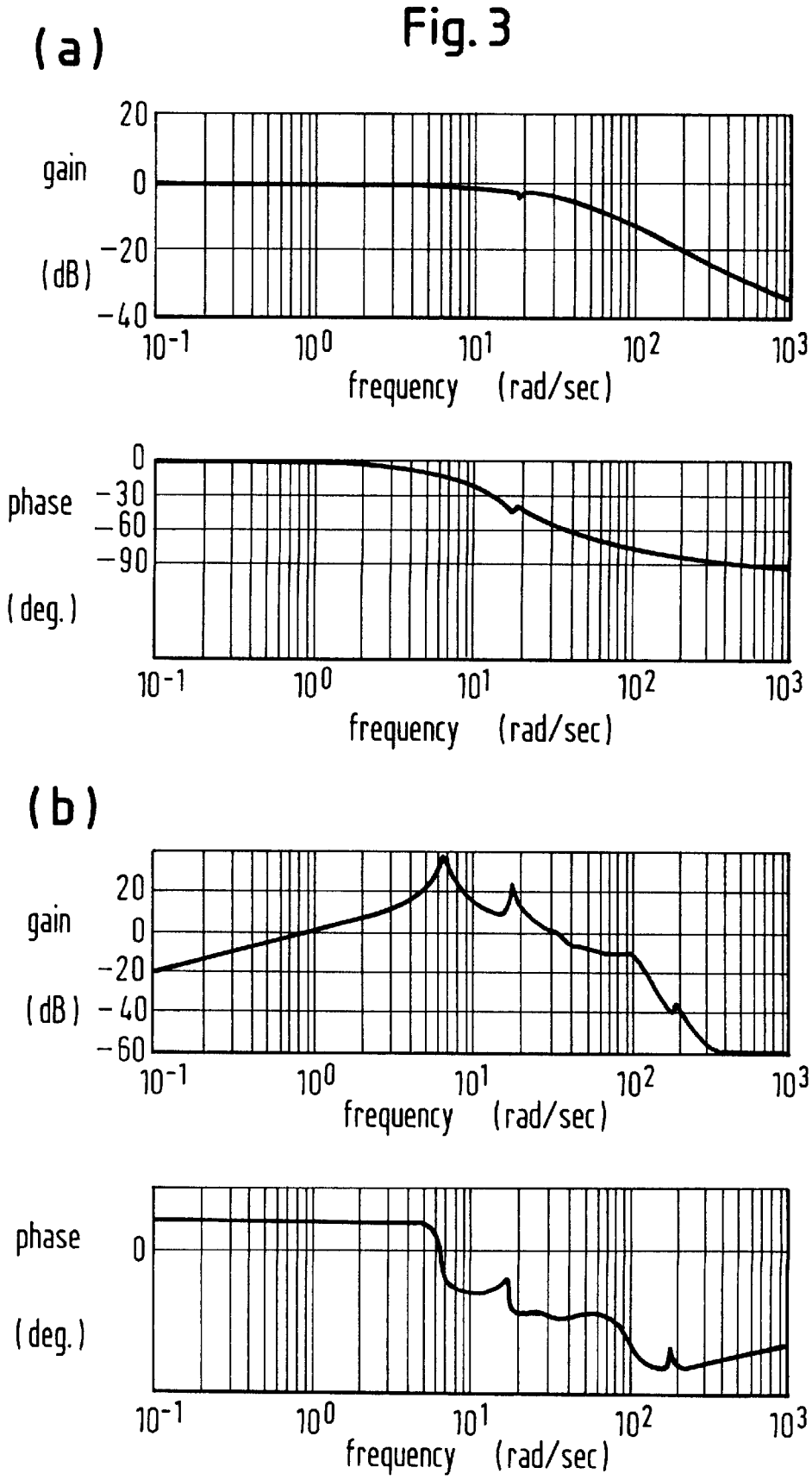
FIG. 3 is a diagram showing the relationship between gain and phase with frequency of a control system of a conventional controller.

FIG. 3(*a*) shows frequency characteristics of gain and phase from a car speed command to a motor speed when a motor was operated in a conventional controller and FIG. 3(*b*) shows frequency characteristics of gain and phase from a car speed command to a car acceleration when a motor was operated in a conventional controller. When FIG. 3(*a*) is viewed, the motor speed well followed the speed command value even when there was a change in a car load, while in FIG. 3(*b*) , the acceleration of the car had a large peak near the resonance frequency of the rope and the car and it is seen that a large vibration is generated at this frequency.

Figure 4:
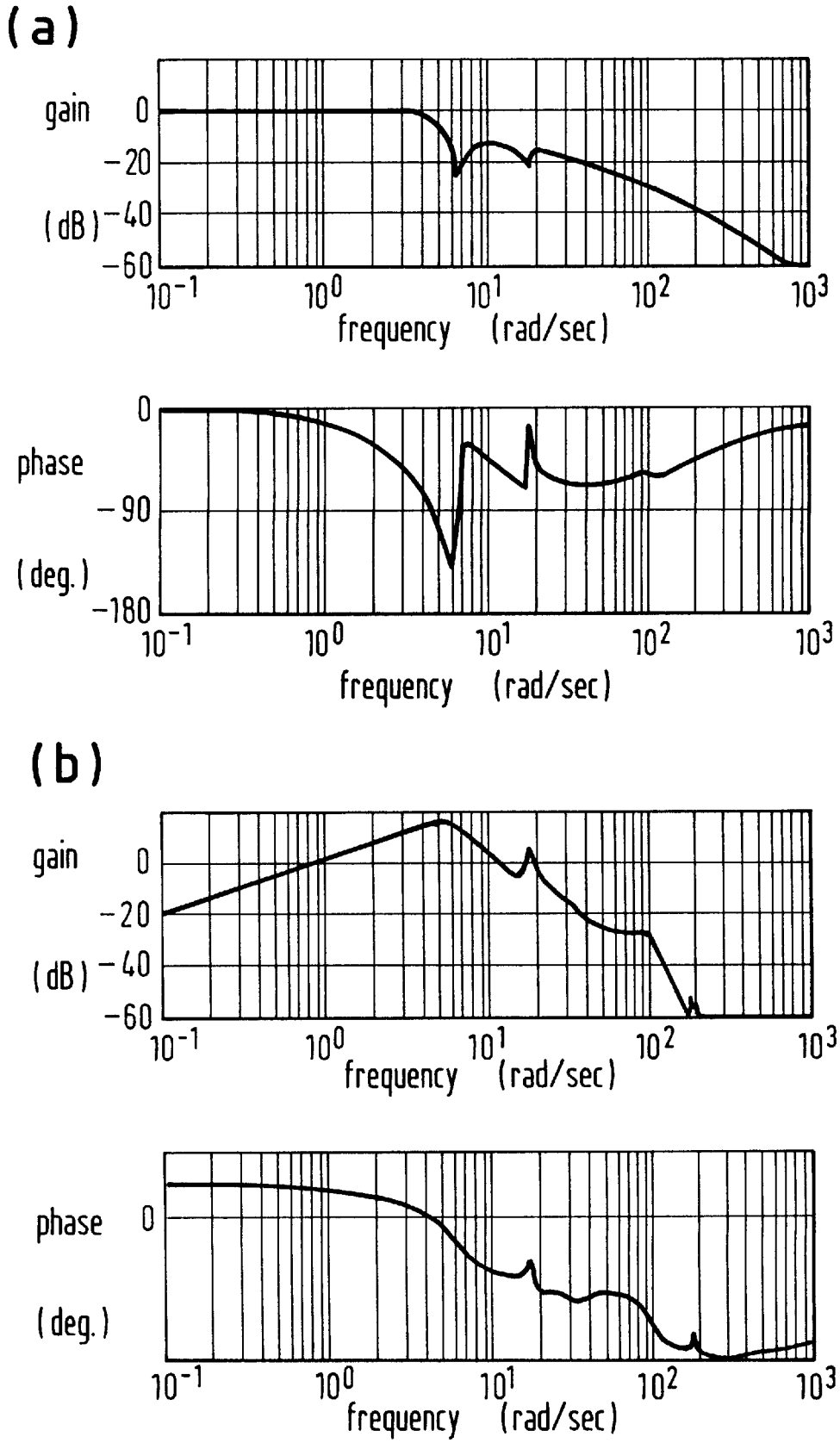
FIG. 4 is a diagram showing the relationship between gain and phase with frequency of a control system of the embodiments shown in FIG. 1.

FIG. 4(*a*) shows frequency characteristics of gain and phase from a car speed command to a motor speed when a motor was operated in this embodiment and FIG. 4(*b*) shows frequency characteristics of gain and phase from a car speed command to a car acceleration when a motor was operated in this embodiment. When FIG. 4(*a*) is viewed, it is seen that gain of a motor speed drops just at resonance frequency and as its effect, such as shown in FIG .4(*b*), the peak of a car acceleration near the resonance frequency of the rope and the car drops by more than 20 dB than a conventional controller. As a result, the vibration drops to about 1/10. As a motor is driven at 4 rad/sec or below and the upward/downward movement is not affected and phase also does not exceed 180°, the control system is kept stable.

Thus, a motor is used not only as a driving unit for the upward/downward movement of a car but also as a vibration suppressing unit to decrease vibration of a car and therefore, no new device for vibration suppression is required and furthermore, only by adding a car speed command value correcting means 20 in simple structure, it becomes possible to reduce a car vibration easily in this embodiment.

Thus, according to the first embodiment, it is possible to suppress vibration of an elevator of which natural frequency is largely variable. Further, since control gains of an elevator controller are presented analytically in the form of numerical expressions, the readjustment of control gain is not required when changing sizes of such equipment as car, motor, sheave and the like and it is possible to compute optimum control gain according to the substitute computation. Furthermore, in the speed response adjustment, when introducing coefficients for adjustment, it becomes easy to adjust the speed response to a desired level. As a result, it becomes possible to make the control gain adjustment remarkably easily, which so far required much time.

Figure 5:
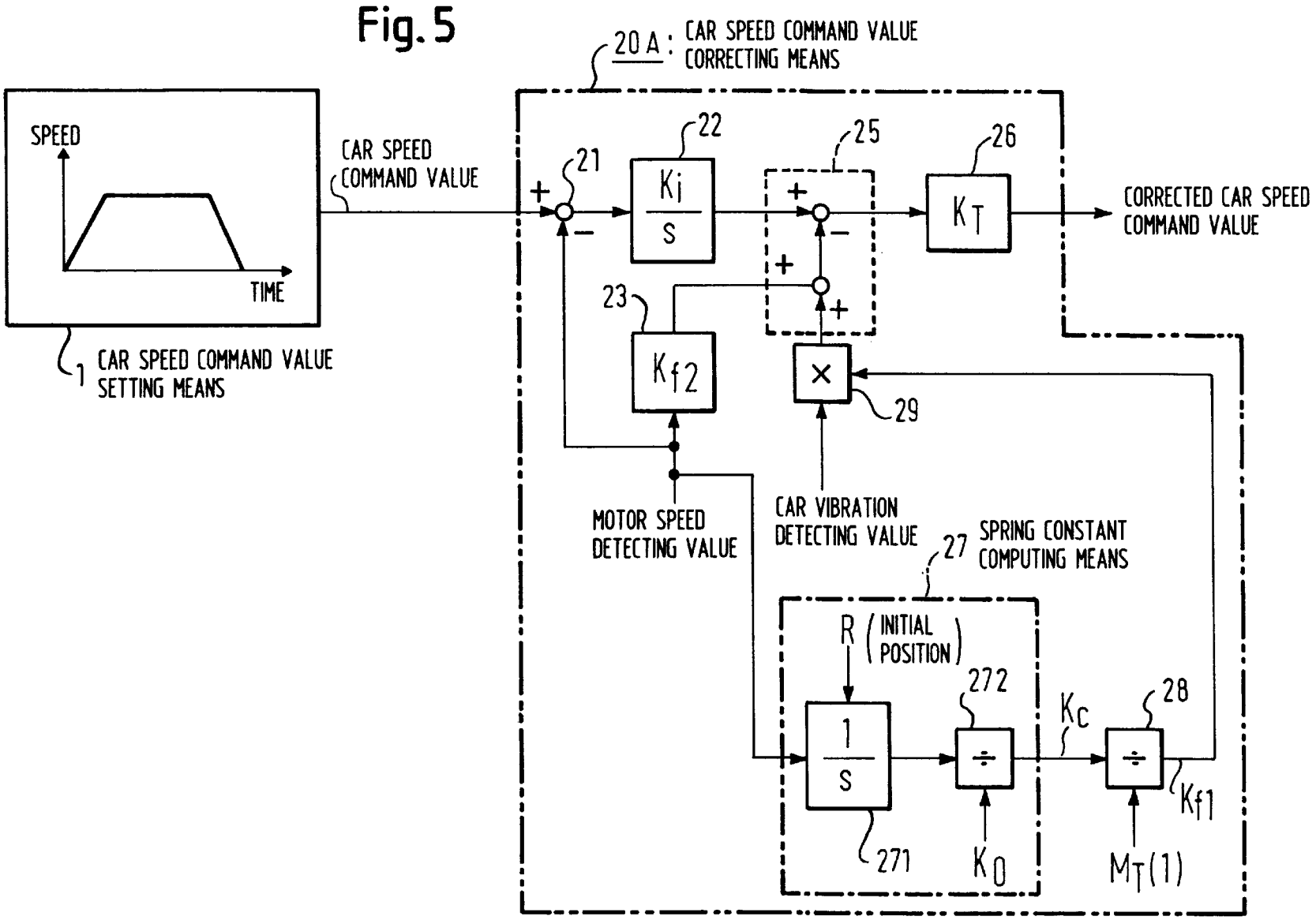
FIG. 5 is a block diagram showing the detailed structure of the principal parts of a second embodiment of this present invention.

In the first embodiment, the spring constant $K_c$ is set at a constant value but this value is variable depending on the length of a rope. FIG. 5 is a block circuit diagram showing the structure of a second embodiment intended to further improve the control performance by considering this. This embodiment differs from the first embodiment in that a car speed command value correcting means 20A is used instead of the car speed command value correcting means 20 shown in FIG. 2. This embodiment is in such structure that the feedback gain $K_{f1}$ to be applied to a car vibration detected value is computed according to a motor speed detected value.

Here, a spring constant computing means 27 is composed of an integrating means 271 and a dividing means 272. The integrating means 271 is reset when a car reaches an initial position, for instance, the main floor, etc. and a car position detecting signal is output by integrating a motor speed detected value when a car is moved. The dividing means 272 obtains a spring constant $K_c$ by executing the computation of the expression (6) , that is, $K_0/L$ regarding a car position signal as a rope length L.

This spring constant computing means 27 is connected with a dividing means 28. This dividing means 28 obtains the feedback gain $K_{f1}$ by executing the expression (2) , that is, $M_T/K_c$ or the computation of the expression (3), that is the computation of $1/K_c$. Further, a multiplying means 29 multiplies a car vibration detected value from the car vibration detecting means 6 by the feedback gain $K_{f1}$ and outputs a value obtained thereto to a subtracting means 25.

Thus, according to the second embodiment, the spring constant $K_c$ of which value varies depending on the length of a rope is computed successively and the feedback gain $K_{f1}$ corresponding to this spring constant $K_c$ is determined and therefore, there is an effect to improve the control performance higher than the first embodiment.

By the way, said first and second embodiments are examples of the structure on the basis of the analog control. Although there are various examples of the structure to replace an analog controller with a digital controller, the structure to display the control performance of said first and second embodiments to the maximum is demanded.

Figure 6:
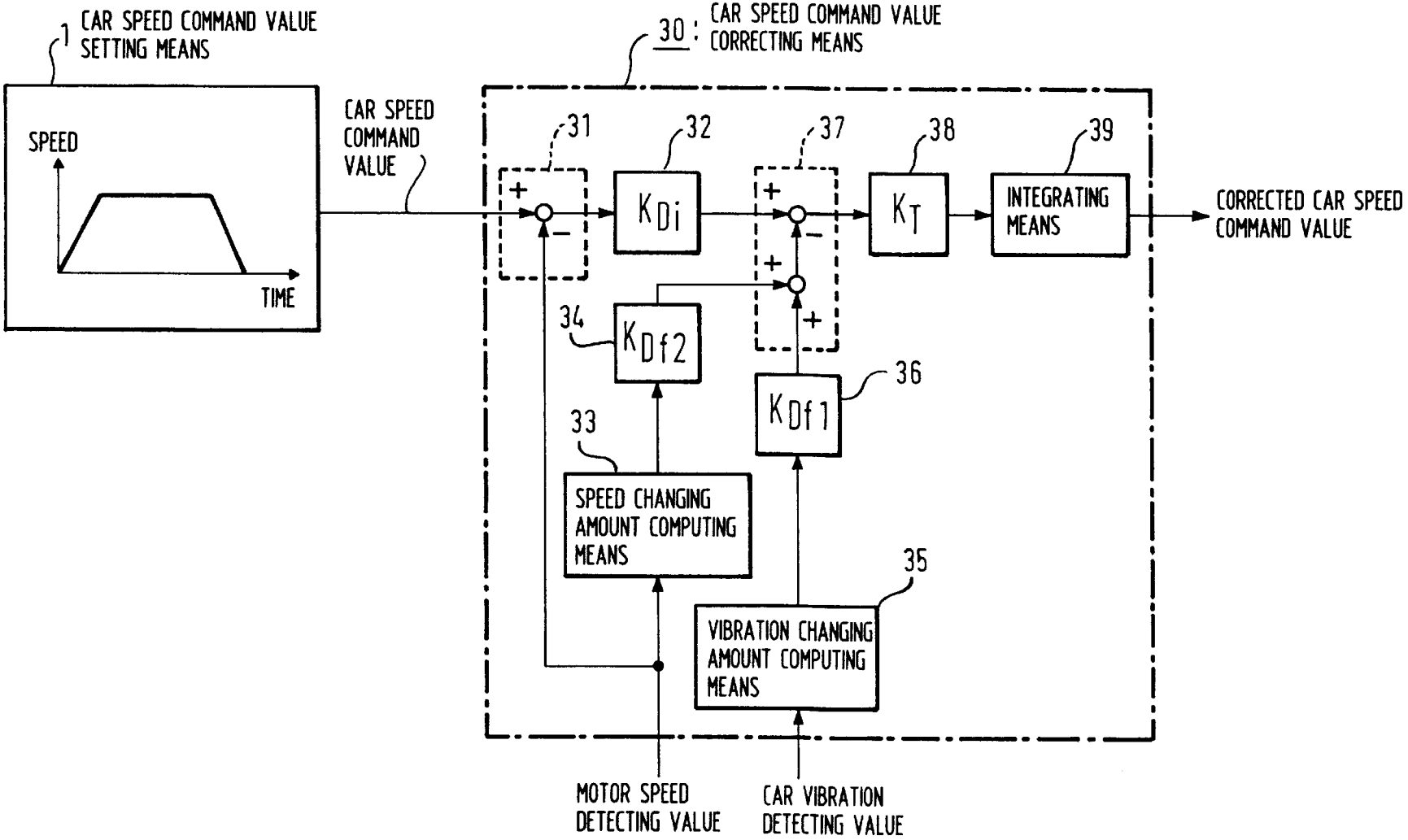
FIG. 6 is a block circuit diagram showing the detailed structure of the principal parts of a third embodiment of the present invention.
Figure 7:
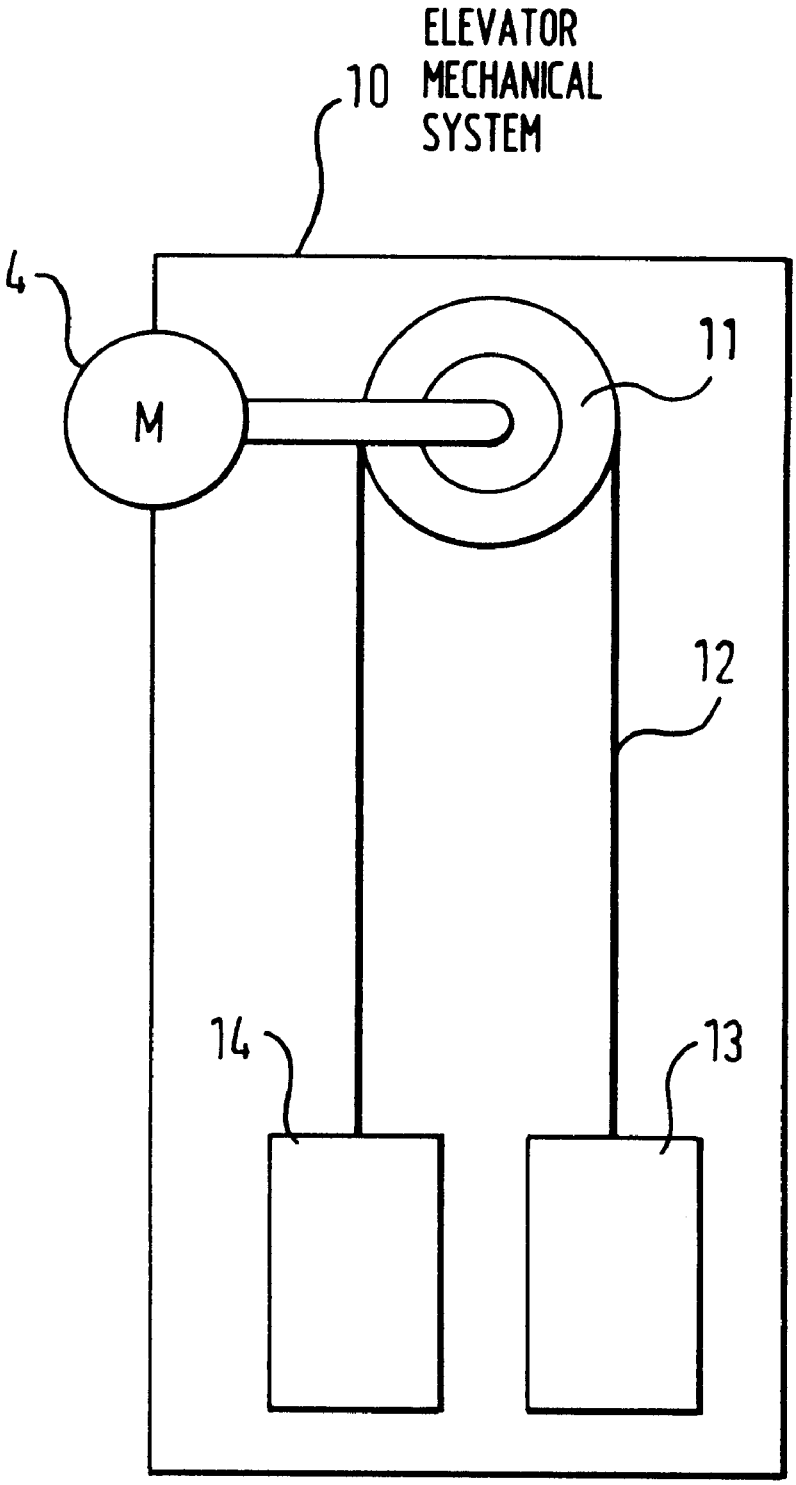
FIG. 7 is a schematic diagram of the mechanical system of an elevator which is an object of application of the present invention.

FIG. 6 is a functional block diagram showing the structure of a third embodiment satisfying this demand. In this embodiment, a car speed command value correcting means 30 is used instead of said car speed command value correcting means 20 or car speed command value correcting means 20A. This car speed command value correcting means 30 comprises a subtracting means 31, a coefficient multiplying means 32, a speed changing amount computing means 33, a coefficient multiplying means 34, a vibration changing amount computing means 35, a coefficient multiplying means 36, an adding/subtracting means 37, a coefficient multiplying means 38 and a integrating means 39.

In this case, upon receipt of an elevator starting command, the car speed command value setting means 1 sets a car speed command value for every sampling period. Corresponding to this setting, the subtracting means 31 obtains a speed deviation by subtracting a motor speed detected value from a car speed command value for every sampling period and outputs it to the coefficient multiplying means 32. The coefficient multiplying means 32 multiplies the output of the subtracting means by an integrating gain $K_{Di}$ and outputs a value obtained to the adding/subtracting means 37.

On the other hand, the speed change amount computing means 33 computes a difference between a motor speed detected value detected last time by the motor speed detecting means 7 for every sampling period and a motor speed detected value detected this time and outputs it to the coefficient multiplying means 34. In the coefficient multiplying means 34, the speed deviation computed by the speed change amount computing means 33 is multiplied by the feedback gain $K_{Df2}$ and the obtained value is output to the subtracting means 37. Further, the vibration change amount computing means 35 computes a difference between the car vibration detected value of last time and that of this time for every sampling period and outputs it to the coefficient multiplying means 36. In the coefficient multiplying means 36, the vibration value deviation computed by the vibration change amount computing means 35 is multiplied by the feedback gain $K_{Df1}$ and the value obtained is output to the adding/subtracting means 37.

Then, the adding/subtracting means 37 adds up the output of the coefficient multiplying means 34 and that of the coefficient multiplying means 36 and further, subtracts an added value from the output of the coefficient multiplying means 32 and outputs a value thus obtained to the coefficient multiplying means 38. The coefficient multiplying means 38 multiplies the output of the adding/subtracting means 37 by the total gain $K_T$ and outputs the obtained value to the integrating means 39. The integrating means 39 executes the integrating operation substantially by adding the output of this time to the output of last time of the coefficient multiplying means 38 for every sampling period and outputs a value thus obtained as a corrected car speed command value.

Here, an integrating gain $K_{Di}$, feedback gains $K_{Df1}$, $K_{Df2}$ and a total gain $K_T$ are determined to values shown by the following expressions:

$$K_{Di}=\omega_c \cdot \Delta T \tag{9}$$

$$K_{Df1}=M_T/K_c \tag{10}$$

(when a car vibration detected value is an acceleration signal)

$$K_{Df1}=1/K_c \tag{11}$$

(when a car vibration detected value is a load signal)

$$K_{Df1}=1 \tag{12}$$

$$K_T=\sigma \cdot \omega_c \tag{13}$$

$$K_c=K_0/L \tag{14}$$

where, $\omega_c$: Coefficient for adjustment $\Delta T$ : Sampling interval $M_T$: A total mass which is a sum total of car weight less load and car weight with movable load $K_c$: Spring constant of rope $K_0$: Spring constant per unit length of rope $\sigma$: Coefficient for adjustment L: Rope length Further, the rope length L is a rope length from the sheave 11 to the car 13 and can be obtained easily from the position of the car 13. Coefficients $\omega_c$, $\sigma$ for adjustment are to adjust the car vibration to the minimum. In this case, a corrected car speed command value is also equal to those shown by Expressions (7) and (8).

Thus, according to the third embodiment, even when an elevator speed controller is realized using a digital controller, it is possible to suppress vibration of an elevator of which natural frequency is largely variable. In this case, as the structure of a digital controller is analytically presented, it is not necessary to readjust control gain when sizes of a car, motor, sheave, etc. are changed and it is possible to compute an optimum control gain by the substituting computation. Further, for adjusting a speed response, it is easy to adjust it to a desired response by introducing an adjusting coefficient. Thus, it becomes possible to easily adjust a control gain which so far required much time.

Further, although a fixed value was used as the feedback gain $K_{Df1}$ to be applied to the output of the vibration change amount computing means 35 in the third embodiment shown in FIG. 6, it is also possible to make a structure so as to compute a spring constant of a rope successively according to the position of a car and multiply it to the output of the vibration change amount computing means 35 in the same manner as shown in FIG. 5.

In this case, it is sufficient to compose a car speed controller in a structure added with a spring constant computing means to detect a car position by integrating change amounts of a motor speed detected value for every sampling period and compute a spring constant of a rope according to this car position and a computing means to compute the feedback constant $K_{Df1}$ according to the computed spring constant for every sampling period.

Further, in the above embodiments, although a car speed command value was corrected using both a car vibration detected value and a motor speed detected value, if a motor speed is retained in an allowable range even when a car speed reference was corrected by a car vibration detected value, a car speed command value correcting means may be composed by excluding a speed reference correction system based on a motor speed detected value, that is, the subtracting means 21, integrating means 22, coefficient multiplying means 23 and coefficient multiplying system 26 shown in FIG. 2 wherein the first embodiment is shown, the subtracting means 31, coefficient multiplying means 32, speed change amount computing means 33, coefficient multiplying means 34 and coefficient multiplying means 38 shown in FIG. 6 wherein the third embodiment is shown. In this case, the corrected car speed command value becomes $V_{ref}$ added with only $-M_T/K_c \cdot \alpha_c$ or $-1/K_c \cdot f_c$.

Further, in a car speed command value correcting means excluding a speed reference correcting system based on a motor speed detected value, if a car vibration detected value equal to a car speed command value is obtained, a car speed command value correcting means excluding the coefficient multiplying means 24 shown in FIG. 2 showing the first embodiment, the spring constant computing means 27, dividing means 28, multiplying means 29 shown in FIG. 5 showing the second embodiment and the coefficient multiplying means 36 shown i n FIG. 6 showing the third embodiment may be composed. That is, by directly correcting a car speed command value by a car vibration detected value, the car vibration can be suppressed. In this case, the corrected car speed command value becomes $V_{ref}$ with $-\alpha_c$ or $-f_c$ directly added.

Further, all of the embodiments described above are for car speed controllers which convert a car speed command value into a motor speed command value by the speed converting means 2 and control a speed detected value of the motor speed detecting means 5 so as to agree with this speed command value and in addition to the motor speed detecting means 5, another motor speed detecting means 7 is provided to convert a motor speed into a value equal to a car speed command value. When the car speed command value setting means 1 outputs a car speed command value that is converted into a motor speed in advance, the motor speed detecting means 7 can be removed and the output of the motor speed detecting means 5 may be used directly as the input to the car speed command value correcting means 20, 20A and 30. In this case, needless to say, the controller will become the structure with the speed converting means 2 removed.

Or, when the motor speed detecting means 5 outputs a speed detected value which was converted to a car speed, it is also possible to use the output of the motor speed detecting means 5 directly as the input to the car speed command value correcting mans 20, 20A and 30 with the motor speed detecting means 7 removed similarly as described above.

On the other hand, an object for control in the above embodiments was a well-bucket type elevator. The application of the present invention is not limited to this type of elevator and is also applicable to rope type elevators irrespective of roping system, driving system or the position of a driving unit.

As clearly seen in the above explanations, according to the present invention, the vibration of a car is detected, as a car speed command value is corrected by a car vibration detected value so as to suppress this vibration and furthermore, a motor speed to drive a sheave is controlled according to a corrected car speed command value, it is possible to surely suppress the vibration of a car even in case of an elevator of which natural frequency is largely variable.

Further, when a car speed command value set by the car speed command value setting means is corrected so as to suppress the car vibration according to a motor speed detected value and a car vibration detected value, there is also an effect to suppress change in car speed resulting from the suppression of car vibration.

In addition, as control gains are presented analytically in the form of numerical expression, there is also an effect to remarkably simplify the control gain adjustment.

Furthermore, when a spring constant of a rope changing depending on the car position is successively computed and a feedback gain is determined based on this spring constant, it becomes possible to make the higher accurate speed control than that when using a fixed feedback gain.

When a digital controller is used to realize the present invention, a car vibration is detected and a car speed command value is corrected by a car vibration detected value so as to suppress this car vibration and further, a motor speed to drive a sheave is controlled according to the corrected car speed command value and it is therefore possible to certainly suppress a car vibration in case of an elevator of which natural frequency is largely variable.

Further, when a digital controller is used to realize the present invention, a car speed command value set by the car speed command value setting means is corrected so as to suppress a car vibration based on a motor speed detected value and a car vibration detected value and therefore, there is also an effect to suppress a car speed change resulting from the suppression of the car vibration.

Further, when a digital controller is used to realize the present invention, as control gains are presented analytically in the form of numerical expression, there is also an effect to remarkably simplify the control gain adjustment.

In addition, when a digital controller is used to realize the present invention, as a spring constant of a rope which changes depending on the car position is computed successively and a feedback gain is determined based on this spring constant, it becomes possible to make the higher accurate speed control than that using a fixed feedback gain.

What is claimed is:

1. In an elevator speed controller for moving a car up/down via a rope wound around a sheave comprising a mechanical system of a rope type elevator and driven by a motor, which is equipped with a car speed command value setting means for setting a car speed command value upon receipt of a starting command and a motor controller for controlling the motor speed following the car speed command value set by the car speed command setting means, the elevator speed controller comprising:

a motor speed detecting means for detecting a motor speed;

a car vibration detecting means for detecting a car vibration; and a car speed command value correcting means provided between the car speed command value setting means and the motor controller for correcting the car speed command value set by the car speed command value setting means according to a motor speed detected value detected by the motor speed detecting means and a vibration detected value detected by the car vibration detecting value detected by the car vibration detecting means so as to suppress the car vibration and supplying the corrected car speed command value to the motor controller;

wherein the car speed command value correcting means comprises:

a speed deviation computing means for computing a deviation of the motor speed detected value from the car speed command value;

a first computing means for multiplying a speed deviation computed by the speed deviation computing means by a predetermined first constant and integrating an obtained value;

a second computing means for multiplying a motor speed detected value detected by the motor speed detecting means by a predetermined second constant;

a third computing means for multiplying a car vibration detected value detected by the car vibration detecting means by a predetermined third constant;

a fourth computing means for subtracting the outputs of the second and third computing means from the output of the first computing means; and a fifth computing means for multiplying the output of the fourth computing means by a predetermined fourth constant and outputting an obtained value.

2. An elevator speed controller according to claim 1, wherein the car speed command value correcting means comprises:

a spring constant computing means for computing a position of a car by integrating a motor speed detected value detected by the motor speed detecting means and for computing a spring constant of a rope according to the computed car position; and a constant computing means for computing the third constant according to the spring constant computed by the spring constant computing means and supplying the third constant for the computation by the third computing means.

3. In an elevator speed controller for moving a car up/down via a rope wound around a sheave comprising a mechanical system of a rope type elevator and driven by a motor, which is equipped with a car speed command value setting means for setting a car speed command value for every sampling period upon receipt of a starting command and a motor controller for controlling the motor speed following the car speed command value set by the car speed command setting means, the elevator speed controller comprising:

a motor speed detecting means for detecting a motor speed;

a car vibration detecting means for detecting a car vibration; and a car speed command value correcting means provided between the car speed command value setting means and the motor controller for correcting the car speed command value set by the car speed command value setting means for every sampling period according to a motor speed detected value detected by the motor speed detecting means and a vibration detected value detected by the care vibration detecting means so as to suppress a vibration of the car and supplying a corrected car speed command value to the motor controller;

wherein the car speed command value correcting means comprises:

a speed deviation computing means for computing a deviation of the motor speed detected value from the car speed command value for every sampling period;

a speed change amount computing means for computing a difference between the motor speed detected value of the last time and the same of this time detected by the motor speed detecting means for every sampling period;

a first computing means for multiplying a speed deviation computed by the speed deviation computing means by a predetermined first constant;

a second computing means for multiplying a difference of the speed detected value computed by the speed change amount computing means by a predetermined second constant;

a vibration change amount computing means for computing a difference between the car vibration detected value detected last time and the car vibration detected value detected this time for every sampling period;

a third computing means for multiplying a difference of the vibration detected value computed by the vibration change amount computing means by a predetermined third constant;

a subtracter for subtracting the outputs of the second and third computing means from the output of the first computing means;

a fourth computing means for multiplying the output of the subtracter by a predetermined fourth constant; and a fifth computing means for integrating the output of the fourth counting means for every sampling period and for outputting a corrected car speed command value.

4. An elevator speed controller according to claim 3, wherein the car speed command value correcting means comprises:

a spring constant computing means for computing a position of a car by integrating a change amount of the motor speed detected value detected by the motor speed detecting mean for every sampling period and for computing a spring constant of a rope according to the computed car position; and a constant computing means for computing the third constant according to the spring constant computed by the spring constant computing means for every sampling period and supplying the computed third constant for computing the third computing means.

* * * * *